United States Patent [19]

Sayers

[11] Patent Number: 5,015,865

[45] Date of Patent: May 14, 1991

[54] X-RAY-PROTECTIVE SURGICAL GARMENT HAVING A REMOVABLE LEAD INSERT

[76] Inventor: Annette S. Sayers, 1420 N. 131st Ave. Circle, Omaha, Nebr. 68154

[21] Appl. No.: 354,104

[22] Filed: May 22, 1989

[51] Int. Cl.[5] ..... G21F 3/02

[52] U.S. Cl. ..... 250/516.1; 250/515.1; 250/519.1

[58] Field of Search ..... 250/516.1, 519.1, 512.1, 250/515.1

[56] References Cited

U.S. PATENT DOCUMENTS

| | | | |
|---|---|---|---|
| 2,404,225 | 7/1946 | Green | 250/516.1 |
| 2,451,282 | 10/1948 | Feibel | 250/516.1 |
| 2,494,664 | 1/1950 | Lubon | 250/516.1 |
| 2,642,542 | 6/1953 | Weinberg | 250/516.1 |
| 3,052,799 | 9/1962 | Hollands | 250/516.1 |
| 3,093,829 | 6/1963 | Maine | 250/516.1 |
| 3,310,053 | 3/1967 | Greenwood | 250/516.1 |
| 4,196,355 | 4/1980 | Maine | 250/516.1 |
| 4,417,146 | 11/1983 | Herbert | 250/516.1 |
| 4,441,025 | 4/1984 | McCoy, Jr. | 250/516.1 |

*Primary Examiner*—Jack I. Berman
*Assistant Examiner*—Kiet T. Nguyen
*Attorney, Agent, or Firm*—Zarley, McKee, Thomte, Voorhees & Sease

[57] ABSTRACT

A sterile surgical garment having a forward and rearward portion. A forwardly positioned outer layer of substantially the same size and shape as that of the forward portion secured at the bottom edge of the forward portion. Cooperable fasteners secure the unattached portion of the outer layer to the forward portion. X-ray-protective material is removably positioned between the forward portion and the outer layer. A second embodiment is disclosed wherein the X-ray-protective material is removably secured within a removable case. The case is attached to the forward portion by cooperable fasteners.

9 Claims, 5 Drawing Sheets

X-RAY-PROTECTIVE SURGICAL GARMENT HAVING A REMOVABLE LEAD INSERT

TECHNICAL FIELD

This invention relates generally to X-ray protection devices and more specifically to an X-ray-protective surgical garment having a removable X-ray-protective insert.

BACKGROUND OF THE INVENTION

The use of X-rays to assist in medical diagnosis has led to a rapid improvement in the ability of the medical profession to diagnose numerous kinds of illnesses and injuries. However, in recent years there has been a growing concern that the cumulative effect of X-rays on medical personnel will increase the risk of cancer. This concern has resulted in numerous attempts to develop radiation-protective devices for use by both medical personnel and the patient.

While these devices effectively protect the wearer, these devices cannot be worn by the medical personnel when X-rays are taken under surgical conditions. Currently, when an X-ray is required during surgery such as in a hip pinning and other pinning procedures, the surgeon and the supporting staff do not wear radiation protective garments because their extreme weight rapidly fatigue the personnel during surgery. Additionally, present devices cannot be appropriately sterilized and thus are not usable in the sterile environment of the surgery room.

It is therefore a primary objective of the present invention to provide an X-ray-protective surgical garment which can be used within the sterile conditions of an operating room.

A further object of the present invention is to provide an X-ray-protective surgical garment which is sterile.

Another object of the present invention is to provide an X-ray-protective surgical garment in which the X-ray-protective material may be removed without breaking the sterile field.

A correlated object of the present invention is to provide an X- ray-protective surgical garment in which the X-ray-protective material may be added thereto without breaking the sterile field.

A related object of the present invention is to provide an X-ray-protective surgical garment in which the X-ray-protective material can be worn for the desired operation and then removed without requiring the wearer to don a new garment.

SUMMARY OF THE INVENTION

The surgical garment of the present invention is formed from a sterile surgical garment having a forward and rearward portion, and a forwardly positioned outer layer. The outer layer has substantially the same size and shape as the forward portion which extends upwardly from a position slightly below the area adjacent to the reproductive organs. The outer layer has the bottom edge thereof secured to the forward portion adjacent to and slightly below the reproductive organ area. Cooperable fasteners are secured adjacent to the lengthwise edges and the opening provided for the neck of the forward portion to removably secure the remaining unattached portion of the outer layer to the forward portion. X-ray protection is provided by a lead impregnated cloth removably inserted between the forward portion and the outer layer.

A second embodiment is disclosed wherein the X-ray protection is removably inserted within a forwardly positioned sterile case which is removably secured to the forward portion of the surgical garment. The case has substantially the same size and shape as that portion of the forward portion which extends upwardly from a position slightly below the reproductive organs of the wearer when worn. Cooperable fasteners are secured adjacent to the lengthwise edges, the opening provided for the neck of the forward portion to removably secure the case to the forward portion.

DESCRIPTION OF THE PREFERRED EMBODIMENT

Figure 1:
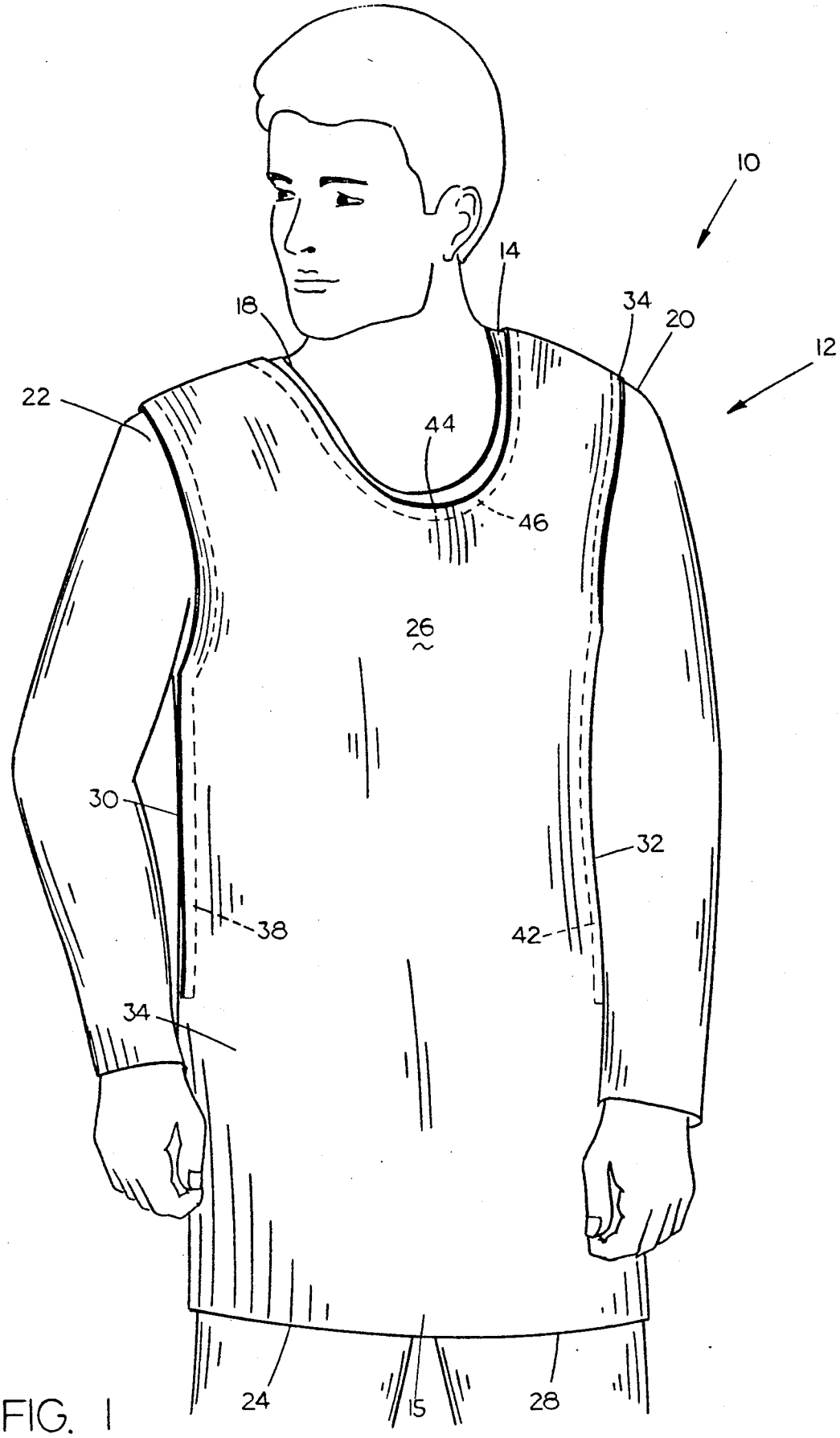
FIG. 1 is a perspective view of the surgical garment of the present invention worn by an individual.
Figure 2:
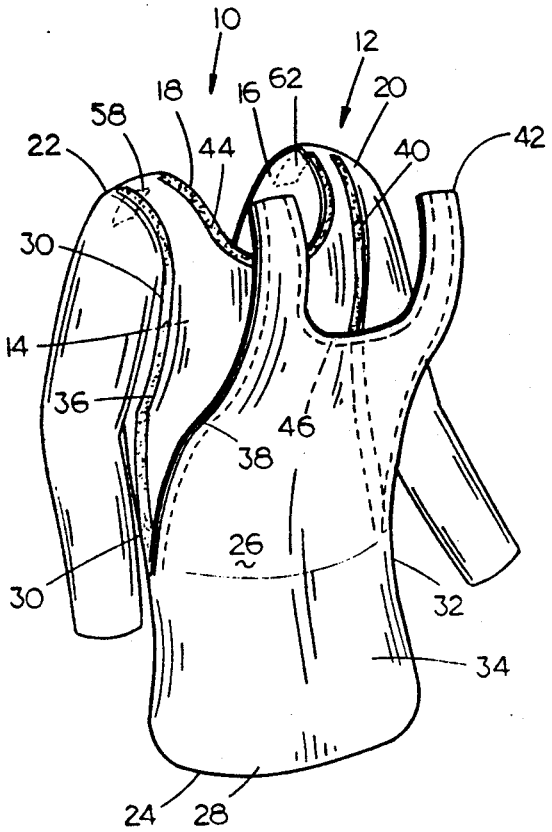
FIG. 2 is a perspective view of the surgical garment of the present invention in which the X-ray-protective material has been removed.

Referring now to the drawings in which identical parts are referred to by the same reference numeral, the surgical garment of the present invention is identified at 10. The surgical garment 10 of the present invention is formed from a sterile surgical garment 12 having a forward portion 14 and a rearward portion 16 with appropriate openings for the neck 18 and the arms 20, 22 and the waist 24.

A forwardly positioned outer layer 26 of sterile material is secured to the forward portion 14, as will be discussed in further detail hereinbelow. The outer layer 26 is comprised generally of the same material as surgical garment 12 and has a shape and dimension which generally corresponds to that of the forward portion 14 and which extends upwardly from a position slightly below the reproductive organs 15 of the user when worn, as illustrated in FIG. 1.

The bottom edge 28 of the outer layer 26 is sewn to the forward portion 14 at a position slightly below the area adjacent to reproductive organs 15 of the wearer. Adjacent to the bottom edge 28 and extending for at least three inches, the outer layer 26 and forward portion 14 are sewn together adjacent the first lengthwise edge 30 of forward portion 14. In a similar manner, outer layer 26 and forward portion 14 are sewn together adjacent the second lengthwise edge 32 of forward portion 14. A small upwardly facing pocket 34 is thereby formed.

Proper X-ray protection requires that the upper torso and reproductive organs 15 of the wearer are protected. Exposure of the reproductive organs to repeated X-ray exposure has been implicated as being likely cause of various types of cancers, birth defects and other medical disorders. As will be discussed hereinafter, in order to provide the proper X-ray protection, the bottom edge 28 of outer layer 14 must be secured at some position below the area adjacent to the reproductive organs 15.

Cooperable fasteners such as Velcro® strips or the like are used to removably secure the remaining unattached portion of outer layer 26 to forward portion 14. A first cooperable fastener having a first half 36 is secured adjacent to the first lengthwise edge 30 with the second half 38 thereof being secured adjacent to the corresponding edge of outer layer 26 as seen in the drawings. A second cooperable fastener having a first half 40 is secured adjacent to the second lengthwise edge 32 with the second half 42 thereof being secured adjacent to the corresponding edge of outer layer 26. A third cooperable fastener having a first half 44 is secured to the forward portion 14 adjacent the opening for the neck 18 with the corresponding second half 46 being secured adjacent to the corresponding edge of outer layer 26.

In the preferred embodiment, the first, second and third cooperable fasteners are continuous in their length. This is to prevent the outer layer from creating unwanted folds which can hinder the wearer. It also can be appreciated that this limits the potential movement of the X-ray-protective material 48 when the same is removably secured between the forward portion 14 and outer layer 26.

Figure 3:
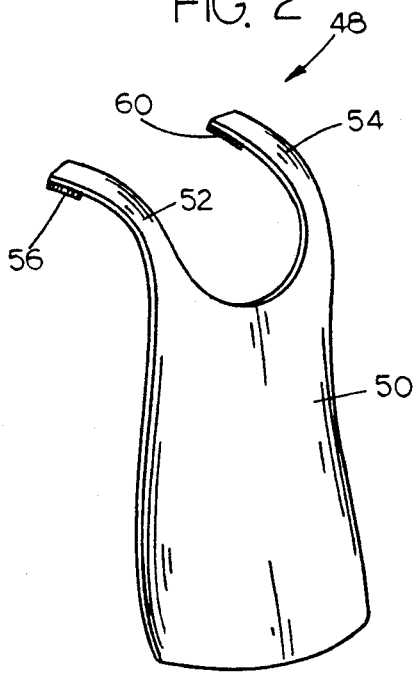
FIG. 3 is a perspective view of the X-ray-protective material.

The X-ray-protective material 48 is formed from lead impregnated cloth. As seen in FIG. 3, the X-ray-protective material 48 is shaped much like a bib with a body portion 50 and two opposing spaced-apart elongated shoulder straps 52 and 54.

A cooperable fastener such as Velcro® is used to removably secure straps 52 and 54 to the rearward portion 16. A cooperable fastener having a first half 56 is secured adjacent to the outermost edge of strap 52 with the corresponding second half 58 being secured to the rearward portion 16. A cooperable fastener having a first half 60 is secured adjacent to the outer most edge of strap 54 with the corresponding second half 62 being secured to the rearward portion 16.

Figure 4:
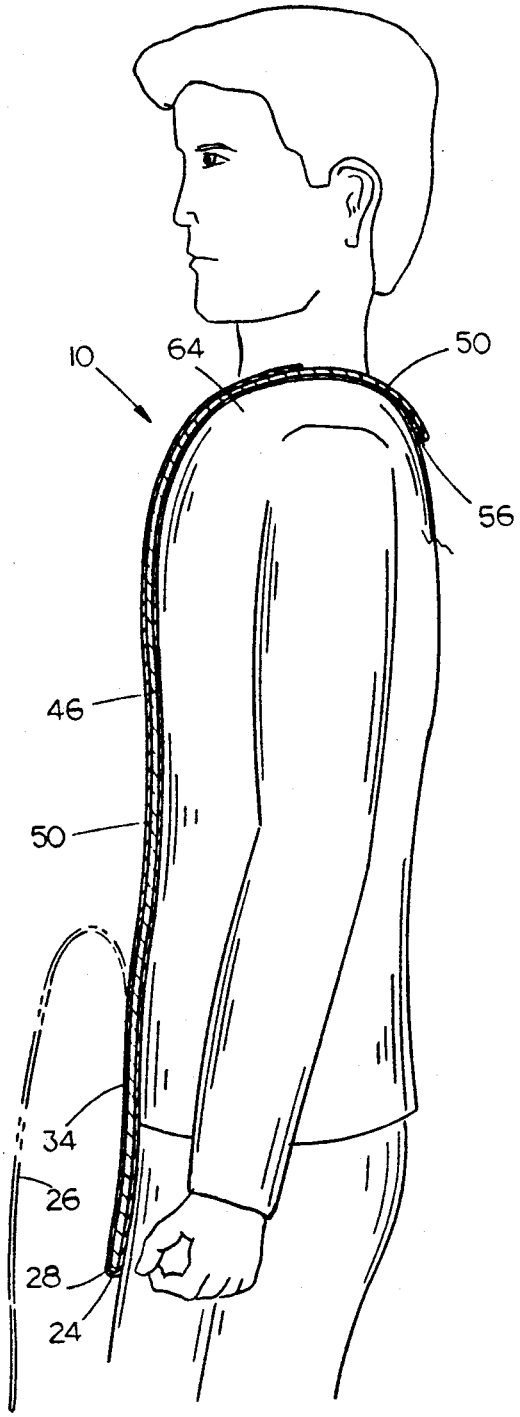
FIG. 4 is a side view of the X-ray-protective garment of the present invention being worn by an individual.
Figure 5:
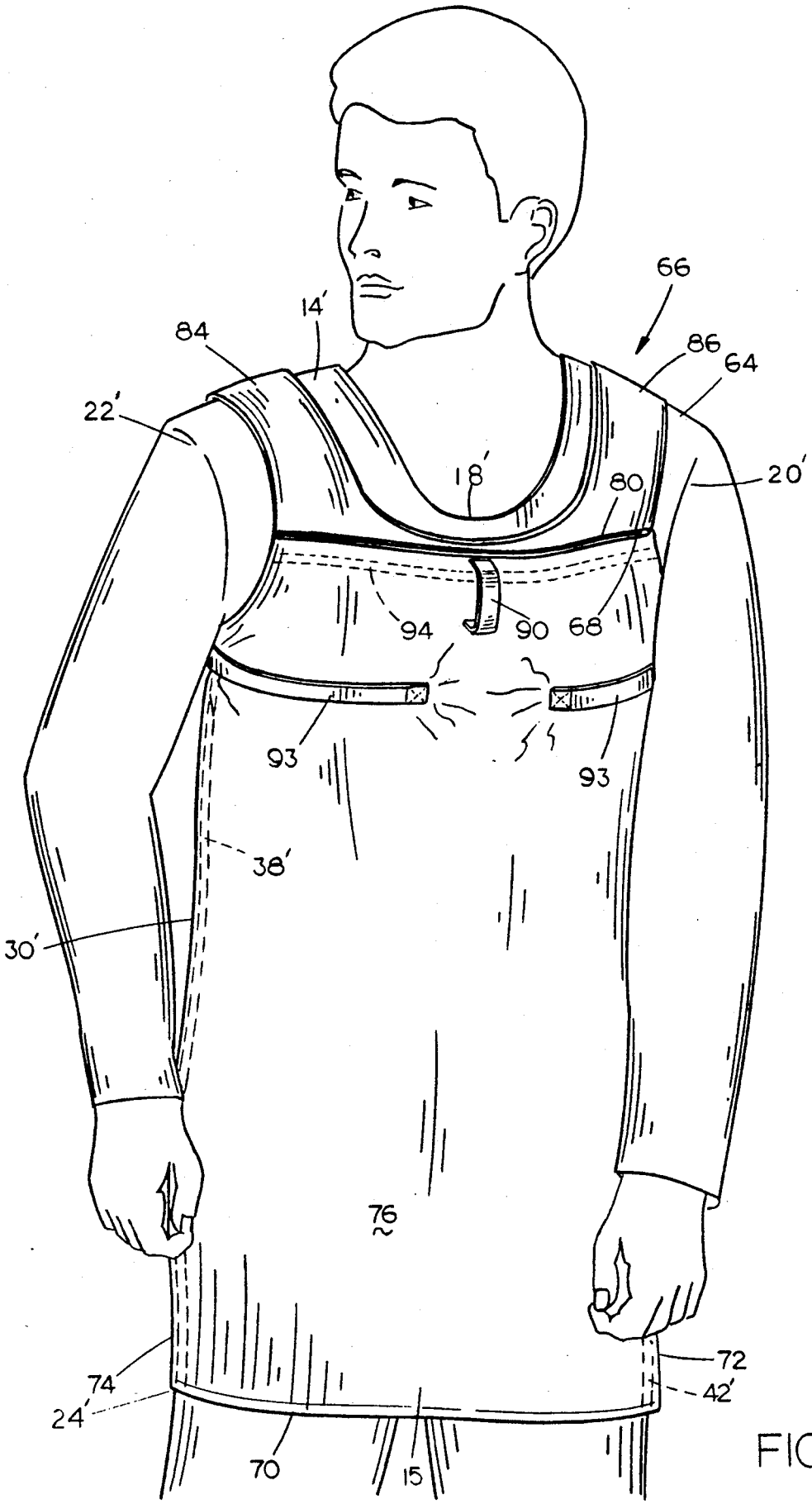
FIG. 5 is a perspective view of a second embodiment of the surgical garment of the present invention worn by an individual.
Figure 7:
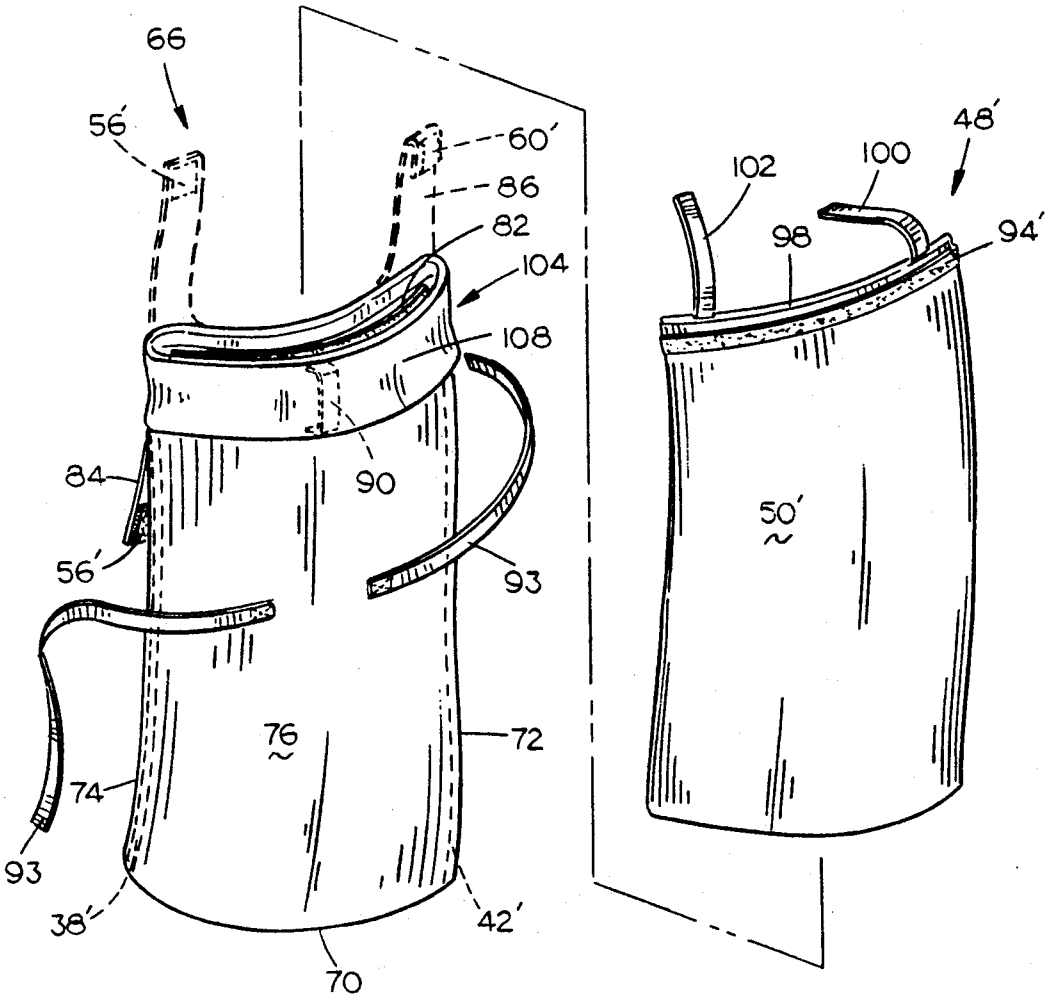
FIG. 7 is a perspective view of the case and X-ray-protective material second embodiment.
Figure 6:
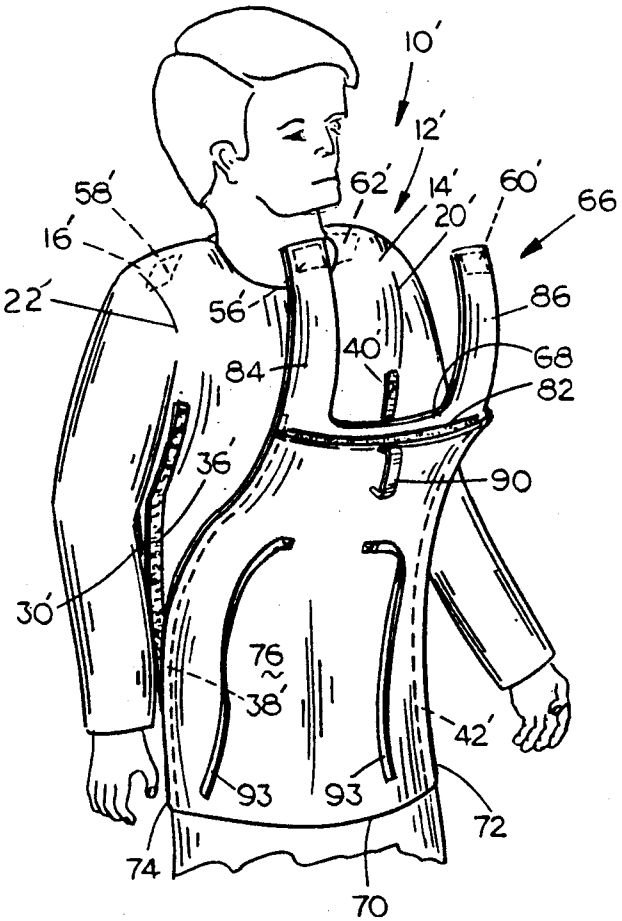
FIG. 6 is a perspective view of the case of second embodiment being partially attached to the forward portion of the surgical garment.

The X-ray-protective material 48 is inserted between the forward portion 14 and the outer layer 26, as seen in the drawings. As illustrated in FIG. 4, the X-ray-protective material 48 is such that the lower end thereof is inserted within pocket 34. Pocket 34 lessens the potential that the X-ray-protective material 48 will inadvertently become separated from the forward portion 14 and rearward portion 59 when in use. Additionally, this insures that the X-ray-protective material 48 will protect the reproductive organ area of the wearer. The lengths of the shoulder straps 52 and 54 are such that they permit the weight of the X-ray-protective material 48 to be uniformly distributed about the shoulders 64 so as to increase the comfort to the wearer.

During the normal course of a surgical operation, the X-ray-protective material 48 will not be inserted between the forward portion 14 and the outer layer 26. However when the X-ray-protective material 48 is required, either the wearer and/or a circulating nurse can unfasten the outer layer 26 from forward portion 14. This permits the insertion of the X-ray-protective material 48 between the forward portion 14 and the outer layer 26, as previously described. A circulating nurse would then provide assistance in properly positioning the X-ray-protective material 48 within pocket 34 and in securing straps 52 and 54 in their appropriate position. The outer layer 26 is then resecured to forward portion 14. The sterile field is not broken during the operation and when an X-ray is needed. When the X-ray-protective material 48 is no longer required, the installation process is reversed.

A second embodiment 10' is additionally disclosed. The surgical garment 10' of the present invention is formed from a sterile surgical garment 12' having a forward portion 14' and a rearward portion 16' with appropriate openings for the neck 18' and the arms 20', 22' and the waist 24'. The second embodiment 10' differs from the first embodiment 10 in that the X-ray-protective material 48' is removable secured in a forwardly positioned case 66. The case 66 is operable attachable to the forward portion 14' of surgical garment 12'. The case 66 is comprised generally of the same material as surgical garment 12' and had a shape and dimension which generally corresponds to that of the forward portion 14 and which extends upwardly from a position slightly below the area adjacent to the reproductive organs 15 of the user when worn. The case 66 will normally be supplied separately from the surgical garment 12' and will not be attached to the forward portion 14' until needed.

Case 66 includes an upper edge 68, a bottom edge 70, first side edge 72 and a second side edge 74. The case 66 is formed from an outer layer 76 which is secured by sewing and the like to inner layer 78. When the case 66 is secured to the garment 12', the inner layer 78 is positioned adjacent to forward portion 14'. The outer layer 76 and inner layer 78 are secured to one another adjacent the bottom edge 70, the first side edge 72 and second side edge 74 by sewing and the like. A case 66 is thereby formed having a cavity 80 with an opening 82 positioned at the upper edge 68 of case 66. A pair of spaced-apart flexible elongated shoulder straps 84 and 86 comprised of nylon webbing are secured adjacent to the upper edge 68.

Figure 8:
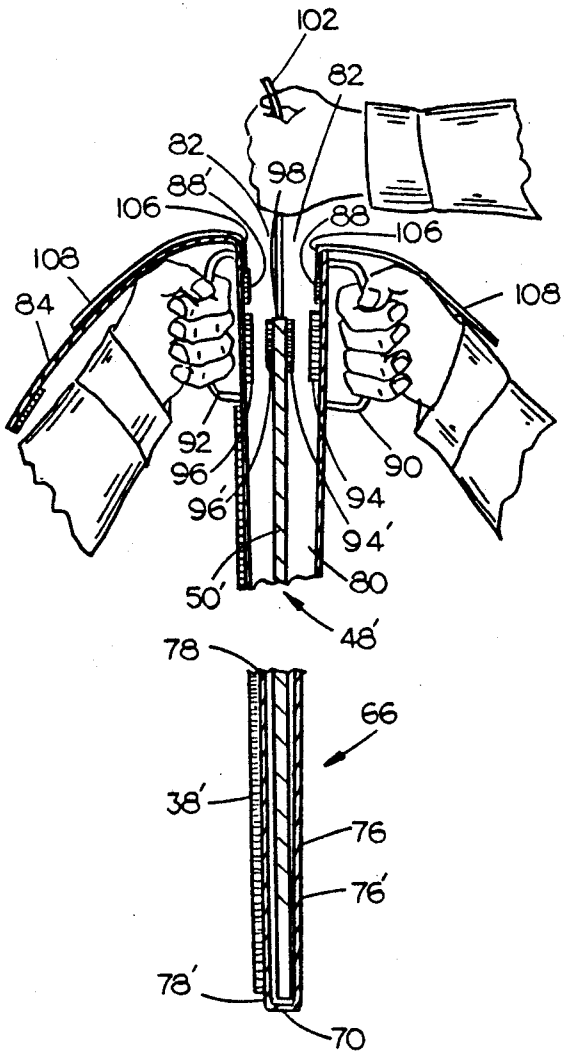
FIG. 8 is a perspective view of the X-ray-protective material being positioned within the case, of the second embodiment.

A cooperable fastener such as Velcro® is utilized to operably close opening 82. A cooperable fastener having a first half 88 is secured to the outer layer 76 and within the cavity 80 and adjacent to opening 82. The corresponding second half 88' is positioned within the cavity and secured to the inner layer 78. A first lengthwise extending mid-positioned hand strap 90 is secured to the outer surface 76' of outer layer 76 adjacent to the opening 82. A second opposing lengthwise hand strap 92 is secured to the outer surface 78' of inner layer 78. Straps 90 and 92 are of a sufficient size to permit a hand to be readily inserted therein as illustrated in FIG. 8. A tie strap 93 is positioned below hand strap 90 as seen in FIG. 8. The tie strap 93 provides an additional means for securing the upper portion of case 66 to the wearer.

A pair of cooperable fasteners such as Velcro® and the like are utilized to secure the X-ray-protective material 48' within cavity 80. The first half 94 of the first cooperable fastener is secured within the cavity 80 to outer layer 76. The first half 95 of a first cooperable fastener is positioned at least two inches below the opening 82 and no further than the lower edge of the hand strap 92. The second half 95 of the first cooperable fastener is secured adjacent the upper 98 of the body portion 50' of X-ray-protective material 48'. The first half 96 of a second cooperable fastener is secured to inner layer 78 and within cavity 80. The first half 96 of the second cooperable fastener is positioned at least two inches below the opening 82 and is positioned no lower than the lowermost edge hand strap 92. The second half 96' of the second cooperable fastener is secured adjacent to the upper edge 98 of the body portion 50' of X-ray-protective material 48. This permits the X-ray-protective material 48 to hang within the case 66 and not bunch up at the bottom thereof.

Figure 10:
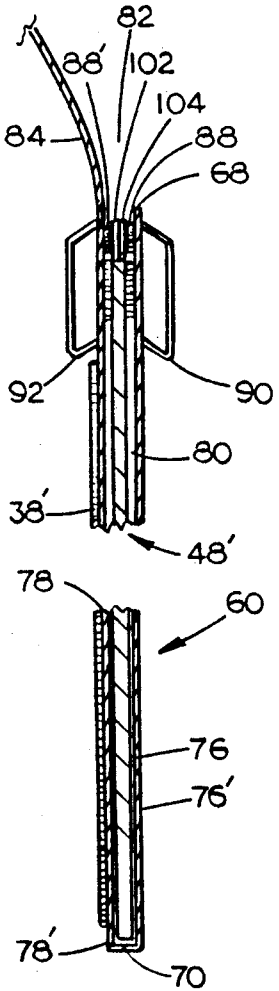
FIG. 10 is a perspective view of the X-ray-protective material fully secured within the case.
Figure 9:
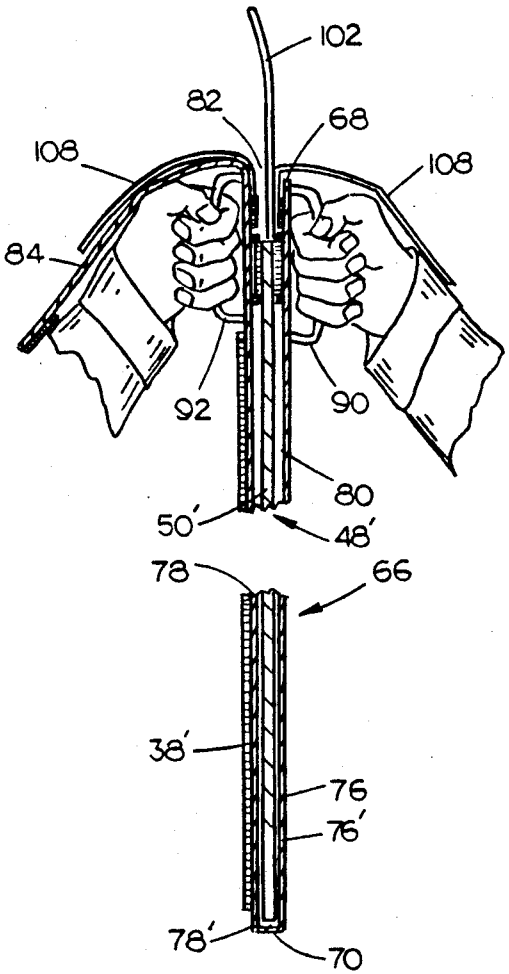
FIG. 9 is a perspective view of the X-ray-protective material being secured within the case of the second embodiment.

The X-ray-protective material 48' includes a first and second opposing flexible hand hold straps 100 and 102 secured adjacent to the upper edge 98 of body portion 50'. The body portion 50' has a length which is slightly less than that of cavity 80, as seen in FIGS. 8, 9, and 10.

The case 66, prior to the insertion of the X-ray-protective material 48' includes a sterility guard 104. The sterility guard 104 is formed from a continuous band of sterile material having the same dimensions as opening 82. The sterility guard 104 can either be loosely positioned or removably secured by a conventional adhesive to the opening 82. The sterility guard 104 has a first portion 106 positioned within the cavity 80 such that it does not interfere with the operation of the cooperable fasteners 94 and 96 used to secure the X-ray-protective material 48' within case 66. A second portion 108 of the sterility guard 104 extends downwardly from the opening 82 and is positioned adjacent and forwardly of outer surfaces 76' and 78' of outer layer 76 and inner layer 78, respectively. The second portion 108 extends downwardly for a sufficient distance to fully cover the first and second hand straps 90 and 92, as seen in FIGS. 8 and 9.

Cooperable fasteners such as Velcro® strips or the like are used to removably secure the case 66 to the forward portion 14. A first cooperable fastener having a first half 36' secured adjacent to the first lengthwise edge 30' with the second half 30' thereof being secured adjacent to the corresponding edge of case 66 as seen in the drawings. A second cooperable fastener having a first half 40' is secured adjacent to the second lengthwise edge 32' with the second half 42' thereof being secured adjacent to the corresponding edge of case 66.

A cooperable fastener such as Velcro® is used to removably secure straps 84 and 86 to the rearward portion 16. A third cooperable fastener having a first half 56' is secured adjacent to the rearward edge of strap 84 with the corresponding second half 58' being secured to the rearward portion 16. A fourth cooperable fastener having a first half 60' secured adjacent to the outermost end of strap 86 with a corresponding half 62' being secured to the rearward portion 16'. The X-ray-protective material 48' is inserted within the cavity 80 as seen in the drawings. As illustrated in FIG. 8, the protective material is such that the lower end thereof of positioned adjacent to the bottom edge 70. Thus, the reproductive area of the wearer is adequately shielded from X-rays. The lengths of the shoulder straps 100 and 102 are such that they permit the weight of the case 66 to be uniformly distributed about the shoulders 64 so as to increase the comfort of the wearer.

The lead impregnated material 48' may either be inserted in the case 66 either prior to the surgical operation and/or during the operation. The X-ray-protective material is inserted into the case 66 in the following manner. A sterile person inserts the appropriate hand into the first and second hand straps 90 and 92, respectively. The second portion of the sterility guard 108 is permitted to drape over the hands and arms of the sterile person. A non-sterile person manipulates the X-ray-protective material 48' utilizing the hand hold straps 100 and 102 to position the X-ray-protective material 48' within cavity 80. When the X-ray-protective material 48' is fully inserted within the cavity 80, the sterile person then presses inwardly with the hands to permit the first half 94 of the first cooperable fastener and the first half 96 of the second cooperable fastener to engage the respective second halves 94' and 96', respectively. The non-sterile person then lays the straps 100 and 102 adjacent the upper edge 98 of the X-ray-protective material 48'. The sterility guard 108 is then removed and the sterile person proceeds to operatively close the opening 82. The non-sterile person then provides assistance in properly securing the case 66 to the forward portion 14' and securing straps 84 and 86 in the appropriate position. Also, the non-sterile person assists in securing tie strap 93 behind the wearer. When the X-ray-protective material 48' is no longer required, the installation process is reversed.

It is further contemplated that other types of cooperable fasteners, such as zippers and the like, could be substituted for the Velcro® strips. Also, other arrangements of cooperable fasteners can be utilized t o removably secure the X-ray-protective material 48 and/or 48'.

The specific shaping and length of the X-ray-protective material 48 and/or 48' and outer layer 26 and/or case 66 will vary depending upon the type of surgical garment. Additionally, pull straps and the like can be secured to the outer layer 26 and/or case 66 so as to assist in unfastening outer layer 26 and/or case 66 to prevent inadvertent contact with the ground.

It can therefore be seen that the present invention accomplishes at least all of its stated objectives.

I claim:

1. An X-ray-protective surgical garment comprising:

a garment having a forward portion and a rearward portion, with appropriate openings formed therein for the neck and arms, a case means having an outer surface, an inner surface, a bottom edge, an open upper edge and spaced-apart side edges to form a cavity within said case means, removably secured to said forward portion, a pair of first and second spaced-apart elongated shoulder straps extending upwardly from said upper edge of said case means;

said first strap having a first half of a cooperable fastener means mounted thereon and a said second half of said cooperable fastener secured to said rearward portion for cooperation with said first half, and said second strap having a first half of a cooperable fastener means mounted thereon and said second half secured to said rearward portion for cooperation with said first half, and said open upper edge being adapted to permit an X-ray-protective means to be removably inserted within said case means, mounting means mounted on said forward portion for securing the case means to said forward portion, whereby said inner surface of said case will be positioned adjacent to and forward of said forward portion, and X-ray-protective means removably positioned within said case means.

2. The X-ray-protective surgical garment of claim 1 wherein said surgical garment and said case are comprised of a sterile material.

3. The X-ray-protective surgical garment of claim 1, wherein said means for securing said case means to said forward portion comprises includes:

a first cooperable fastener strip having cooperable first and second halves, said second half mounted along one side edge of said case means and said first half mounted on said forward portion for cooperation with said second half, and a second cooperable fastener strip having cooperable first and second halves, said second half mounted along the side edge of said case means opposite said first cooperable fastener, and said first half mounted on said forward portion for cooperation with said second half.

4. The X-ray-protective surgical garment of claim 1 wherein said case further comprises a cooperable fastener means positioned adjacent to said upper edge and within said cavity for operably securing the opening, and said cooperable fastener having a first half secured to said outer layer and a second half secured to said inner layer for cooperation with said first half.

5. The X-ray-protective surgical garment of claim 4 wherein said case means further comprises:

a first and second vertically extending hand hold strap, said first hand hold strap being secured to said outer layer adjacent to said upper end; and said second hand hold strap being secured to said inner layer adjacent to said upper end.

6. The X-ray-protective surgical garment of claim 5 wherein said case further comprises a means positioned within cavity for hanging and securing said X-rayprotective material to the case means when said X-ray-protective material is positioned within said cavity of said case means.

7. The X-ray-protective surgical garment of claim 4 wherein said case further includes:

removable band member, formed from a sterile material, which is positioned adjacent to said opening, said band member having a first portion, a second portion, and a width at least equal to said opening, said first portion draped within said cavity adjacent to said opening and extending to said first half of said first and second cooperable fasteners positioned within the cavity;

said second portion being draped over said case, said second portion providing a means for covering the hands and arms of a person holding said case so as to permit the insertion of the X-ray-protective material within said case without contaminating the person hold said case, and said band permitting said X-ray-protective material to be removably inserted within said cavity of said case without having to remove said band.

8. The X-ray-protective surgical garment of claim 1 wherein the X-ray-protective means is comprised of a single sheet of X-ray-protective material having a body portion and two spaced apart elongated straps extending upwardly therefrom.

9. The X-ray-protective surgical garment of claim 1 wherein the X-ray-protective means is comprised of lead impregnated cloth.

* * * * *